US012521778B2

(12) United States Patent
Gieseler

(10) Patent No.: US 12,521,778 B2
(45) Date of Patent: Jan. 13, 2026

(54) MODULAR SPRAY BAR SYSTEM FOR SELECTIVELY COOLING AND/OR LUBRICATING ROLLS

(71) Applicant: SMS group GmbH, Düsseldorf (DE)

(72) Inventor: Friedhelm Gieseler, Freudenberg (DE)

(73) Assignee: SMS group GmbH, Düsseldorf (DE)

( * ) Notice: Subject to any disclaimer, the term of this patent is extended or adjusted under 35 U.S.C. 154(b) by 364 days.

(21) Appl. No.: 18/032,626

(22) PCT Filed: Oct. 15, 2021

(86) PCT No.: PCT/EP2021/078667
§ 371 (c)(1),
(2) Date: Apr. 19, 2023

(87) PCT Pub. No.: WO2022/084196
PCT Pub. Date: Apr. 28, 2022

(65) Prior Publication Data

US 2023/0405657 A1 Dec. 21, 2023

(30) Foreign Application Priority Data

Oct. 21, 2020 (DE) ..... 10 2020 213 287.9

(51) Int. Cl.
*B21B 45/02* (2006.01)

(52) U.S. Cl.
CPC ..... *B21B 45/0233* (2013.01); *B21B 45/0248* (2013.01); *B21B 2045/026* (2013.01)

(58) Field of Classification Search
CPC ..... B21B 27/10; B21B 2027/103; B21B 45/0215; B21B 45/0218; B21B 45/0248; B21B 45/026; B21B 45/0233; B21B 45/0251
See application file for complete search history.

(56) References Cited

U.S. PATENT DOCUMENTS 3,880,358 A * 4/1975 Schaming ..... B21B 45/0233 72/201
4,247,047 A 1/1981 Schaming
4,387,739 A 6/1983 Schaming
4,400,961 A * 8/1983 Schaming ..... B21B 45/0281 72/201
4,539,830 A * 9/1985 Noe ..... B21B 1/26 72/11.8
4,760,961 A 8/1988 Nagai
(Continued)

FOREIGN PATENT DOCUMENTS

DE 20106972 U1 6/2001
DE 102009040876 A1 5/2010
(Continued)

OTHER PUBLICATIONS

KR 20120110546A, Lee et al. Oct. 2012.*
(Continued)

*Primary Examiner* — Edward T Tolan
(74) *Attorney, Agent, or Firm* — Smartpat PLC

(57) ABSTRACT

A modular spray bar system (1) for selectively cooling and/or lubricating rolls, in particular roll barrels, in a rolling mill stand includes different types of blocks and a bracing element by which a spray bar (47) formed from the different blocks can be braced.

12 Claims, 1 Drawing Sheet

(56) References Cited

U.S. PATENT DOCUMENTS

| | | | | |
|---|---|---|---|---|
| 7,837,131 | B2 * | 11/2010 | Huffman | B05B 7/0884 239/139 |
| 2007/0029411 | A1 | 2/2007 | Huffman et al. | |
| 2007/0075164 | A1 | 4/2007 | Wollin | |
| 2011/0275501 | A1 | 11/2011 | Benner | |
| 2016/0101451 | A1 | 4/2016 | Schroeder | |
| 2020/0269295 | A1 | 8/2020 | Dirisamer et al. | |

FOREIGN PATENT DOCUMENTS

| | | | |
|---|---|---|---|
| EP | 3006125 | A1 | 4/2016 |
| JP | S5125431 | A | 3/1976 |
| JP | S51156029 | U | 12/1976 |
| JP | S62214810 | A | 9/1987 |

OTHER PUBLICATIONS

KR 20140081611A, Hwang et al. Jul. 2014.*
JP 03-111549A, Hannoki May 1991.*
Japanese Patent Office, Office Action in related application JP2023520084.
United States Controls, Roll Cooling Spray Systems, retrieved from https://www.unitedstatescontrols.com/roll-cooling-spray-systems/ , Jul. 13, 2020.

* cited by examiner

2

47

MODULAR SPRAY BAR SYSTEM FOR SELECTIVELY COOLING AND/OR LUBRICATING ROLLS

CROSS-REFERENCE TO RELATED APPLICATION

This application is a national stage application, filed under 35 U.S.C. § 371, of International Patent Application No. PCT/EP2021/078667, filed on 15 Oct. 2021, which claims the benefit of German Patent Application No. 10 2020 213 287.9, filed 21 Oct. 2020.

TECHNICAL FIELD

The present disclosure relates to a modular spray bar system for selectively cooling and/or lubricating of rolls and/or rolled material, in particular roll barrels, in a rolling mill stand.

BACKGROUND

Spray bars for applying a cooling and/or lubricating medium to the surface of rolls arranged in a rolling mill stand are generally known from the prior. Such spray bars are designed individually for the corresponding rolling mill stand and the rolling task and are made in one piece, such that an adaptation of the rolled material and to changing rolling tasks and/or a different type of plant always requires a complete exchange thereof.

For example, DE 10 2009 040 876 A1 discloses a spray bar for cooling a roll arranged in a rolling mill stand, which is designed in one piece and arranged in the rolling mill stand so as to be pivotable about a pivot axis parallel to the roll axis, and which permits individual cooling.

Furthermore, a spray bar with a one-piece base body, which can be fitted with different nozzle plates in modular fashion to allow a flexible response to changing rolling tasks, is known from U.S. Pat. No. 4,247,047.

SUMMARY

The present disclosure is based on the object of further designing a spray bar so that it can be easily adapted to changing rolling tasks, can be manufactured at low cost and does not require any spare parts.

In accordance with the invention, the object is achieved by a modular spray bar system as claimed.

The modular spray bar system for selectively cooling and/or lubricating rolls and/or rolled material comprises at least one central connection block having at least one first fluid connection, which opens into a first main bore extending in the direction of a spray bar axis, which main bore forms a part of a first main fluid channel of a spray bar, along with at least one first transverse bore, which extends transversely from the first main bore and opens into a first fluid outlet opening; at least two central extension blocks connectable to the central connection block, wherein each of the central extension blocks has a first main bore extending in the direction of the spray bar axis, which main bore forms a part of the first main fluid channel of the spray bar, and at least one first transverse bore, which extends transversely from the first main bore and opens into a first fluid outlet opening; at least two outer extension blocks connectable to the central extension blocks, wherein each of the outer extension blocks has a first main bore extending in the direction of the spray bar axis, which main bore forms a part of the first main fluid channel of the spray bar, along with at least one first transverse bore, which extends transversely from the first main bore and opens into a first fluid outlet opening; at least two outer connection blocks connectable to the outer extension blocks, each having at least one second fluid connection, which opens into a first main bore that is closed on one side and extends in the direction of the spray bar axis, which main bore forms an end part of the first main fluid channel of the spray bar; and at least one bracing element by means of which the spray bar formed from the different blocks can be braced.

The fully modular spray bar system enables a solution tailored to the respective requirements of the rolling mill stand and/or changing rolling task by allowing the respective blocks to be individually assembled to form a spray bar. Since the system comprises only four different types of blocks, series production of these is particularly cost-effective and does not require the particular customer to keep any spare parts, such that additional storage costs can be avoided. The modular structure of the entire spray bar also enables rapid replacement in the event of wear of one or more blocks, without the need for costly removal and maintenance of the entire spray bar.

Further advantageous embodiments of the invention are indicated in the dependent formulated claims. The features listed individually in the dependent formulated claims can be combined with one another in a technologically useful manner and can define further embodiments of the invention. In addition, the features indicated in the claims are further specified and explained in the description, wherein further preferred embodiments of the invention are illustrated.

In an advantageous embodiment, it is provided that each of the blocks has a second main bore running parallel to the first main bore, each of which forms a part of a second main fluid channel of the spray bar. In this connection, it is particularly preferred that each of the blocks selected from the series of central connection block, central extension block and outer extension block comprises at least one second transverse bore, which extends transversely from the second main bore and opens into a second fluid outlet opening. It is particularly preferred that the second main fluid channel has a larger cross-section relative to the first main fluid channel, via which the cooling and/or lubricating medium for roll barrel cooling can be conveyed within the spray bar to the respective transverse bores and the adjoining fluid or coolant outlet openings, as the case may be. The different channels also allow the cooling and/or lubricating medium to be conveyed at the same or different pressures, such that adaptation to the rolling task to be performed in each case is ensured.

In principle, the second main fluid channel can be fluidically connected to the first main fluid channel. Advantageously, however, it is provided that both main fluid channels are not fluidically connected to one another and that each of the outer connection blocks then comprises at least one respective third fluid connection, which opens into the second main bore. Thereby, it is preferably provided that the second main bore of each of the outer connection blocks is closed on one side.

In a further advantageous embodiment, it is provided that each of the blocks comprises at least one nozzle plate for receiving spray nozzles. Each of the nozzle plates advantageously comprises at least two openings arranged one above the other, into which the spray nozzles can be inserted for cooling and/or lubricating. Thereby, it is particularly preferred that all nozzle plates are standardized in terms of their dimensions, such that only one basic type of nozzle plate is required for the different blocks. The spray bar and the nozzles can be adapted to the corresponding cooling and/or lubrication requirements by means of differently designed spray nozzles, which are available in a large selection with regard to the flow rate and their spray characteristics.

In principle, a single nozzle plate with the corresponding spray nozzles can be arranged on each of the blocks, with the exception of the central connection block. Advantageously, it is provided that the central connection block comprises two nozzle plates, wherein each of the nozzle plates in turn comprises two openings for the spray nozzles arranged one above the other.

Furthermore, it is preferably provided that each of the blocks comprises at least one integrated control valve via which the individual spray nozzles and/or groups of spray nozzles can be individually controlled.

Preferably, each of the blocks has at least one connection bore for receiving a fastening element on its contact surfaces directed towards the neighboring blocks.

In order to arrange and fix the spray bar to the rolling mill stand, the two outer connection blocks each have at least one connection element for connecting the spray bar in the stand.

In a further aspect, the present disclosure further relates to the use of the spray bar system to form a spray bar for selectively cooling and/or lubricating rolls and/or rolled material.

The invention and the technical environment are explained in more detail below with reference to the figures. It should be noted that the invention is not provided to be limited by the exemplary embodiments shown. In particular, unless explicitly shown otherwise, it is also possible to extract partial aspects of the facts explained in the figures and combine them with other components and findings from the present description and/or figures. In particular, it should be noted that the figures and especially the size relationships shown are only schematic. Identical reference signs designate identical objects, such that explanations from other figures can be used as a supplement if necessary.

DETAILED DESCRIPTION

Figure 1:
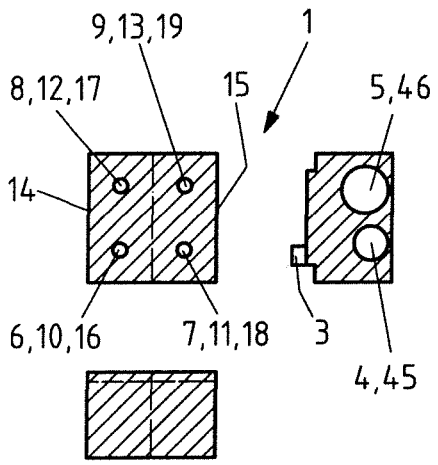
FIG. 1 shows an embodiment of a central connection block.

FIG. 1 shows an embodiment of a central connection block 1 for a modular spray bar system 2, which is provided for selectively cooling and/or lubricating rolls (not shown). The central connection block 1 is substantially in the form of a cuboid building block, in order to allow individual and modular assembly. This and each of the other blocks can be made of metallic and/or non-metallic materials.

In the present embodiment, the central connection block 1 comprises a fluid connection 3 at the rear side, which fluid connection opens into a first main bore 4. Parallel to the first main bore 4, the central connection block 1 comprises a second main bore 5, which has a larger cross-section. Both main bores 4, 5 extend along the spray bar axis, and thereby each form a part of the media supply to the respective spray nozzles (not shown). As can further be seen from the illustration in FIG. 1, the central connection block 1 has four transverse bores 6, 7, 8, 9, wherein the first two transverse bores 6, 7 extend transversely from the first main bore 4 and the second two transverse bores 8, 9 extend transversely from the second main bore 5 and each opens into a first or second fluid outlet opening 10, 11, 12, 13, as the case may be, which are arranged at the front side of the connection block 1.

Furthermore, the central connection block 1 comprises two nozzle plates 14, 15, which are screwed at the front side of the connection block 1. Each of the nozzle plates 14, 15 is provided with two openings 16, 17, 18, 19, which are aligned with the respective fluid outlet openings 10, 11, 12, 13 and are provided to receive spray nozzles (not shown).

Figure 2:
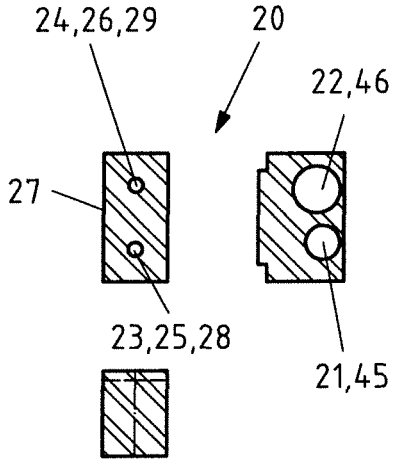
FIG. 2 shows an embodiment of a central extension block.

FIG. 2 shows an embodiment of a central extension block 20, which is connectable to the central connection block 1. The central extension block 20 also has a first main bore 21 extending in the direction of the spray bar axis along with a second main bore 22 arranged parallel thereto, each of which forms a part of the media supply to the spray nozzles. At the front side, the central extension block 20 comprises a first and a second transverse bore 23, 24, each of which extends transversely from the first main bore 21 or the second main bore 22, as the case may be, and each of which opens into a first and a second fluid outlet opening 25, 26, which fluid outlet openings are arranged at the front side of the central extension block 20. In contrast to the connection block 1, the extension block 20 comprises a nozzle plate 27, which is also attached at the front side of the central extension block 20 via screw connections (not shown). Since all nozzle plates of the spray bar system 2 have the same design, the nozzle plate 27 also has two openings 28, 29, which are aligned with the respective fluid outlet openings 25, 26.

Figure 3:
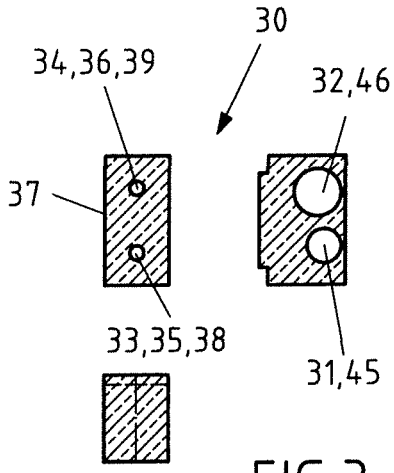
FIG. 3 shows an embodiment of an outer extension block.

FIG. 3 shows an embodiment of an outer extension block 30 that is connectable to the central extension block 20. Like the central extension block 20, the outer extension block 30 has a first main bore 31 extending in the direction of the spray bar axis along with a second main bore 32, each of which forms a part of the media supply to the spray nozzles. At the front side, the outer extension block 30 comprises a first and a second transverse bore 31, 32, each of which extends transversely from the first main bore 31 or the second main bore 32, as the case may be, and each of which opens into a first or a second fluid outlet opening 35, 36, as the case may be, which fluid outlet openings are arranged at the front side of the outer extension block 30. At the front side, the outer extension block 30 comprises a nozzle plate 37 having two openings 38, 39, which are aligned with the respective fluid outlet openings 35, 36.

Figure 4:
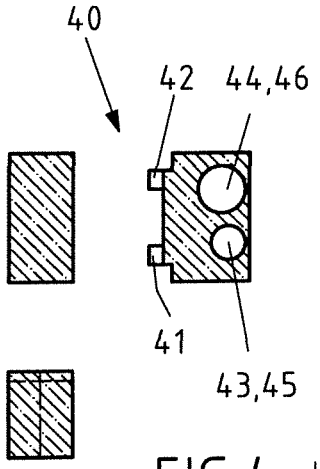
FIG. 4 shows an embodiment of an outer connection block.

FIG. 4 shows an embodiment of an outer connection block 43, which is connectable with the outer extension blocks 33 to the modular spray bar system 2 and forms distal terminal elements of the spray bar 22. The outer connection block 43 has, at the rear side, two fluid connections 44, 45 that open into a main bore 46 or a secondary bore 47, as the case may be. Thereby, the two bores 46, 47 each form a closing part of the channel for the media supply to the spray nozzles of the spray bar 22 and are therefore closed on one side. In contrast to blocks 1, 23, 33, the outer connection block 43 in the present embodiment does not have any transverse bores or a nozzle plate. Further, the outer connection block 43 comprises a fastening element, which is used to secure the spray bar 22 in a stand (not shown).

FIG. 4 shows an embodiment of an outer connection block 40, which is connectable to the outer extension blocks 30 to form the modular spray bar system 2 and forms distal terminal elements of the spray bar. The outer connection block 40 has second and third fluid connections 41, 42 at the rear side, wherein the second fluid connection 41 opens into a first main bore 43 and the third fluid connection 42 opens into a second main bore 44. Thereby, the two main bores 43, 44 each form a closing part of a first or a second main fluid channel 45, 46, as the case may be, of the spray bar, and are therefore closed on one side. In contrast to blocks 1, 20, 30, the outer connection block 40 in the present embodiment does not have any transverse bores or a nozzle plate. Further, the outer connection block 40 comprises a connection element 47, which is used to secure the spray bar in a stand (not shown).

Figure 5:
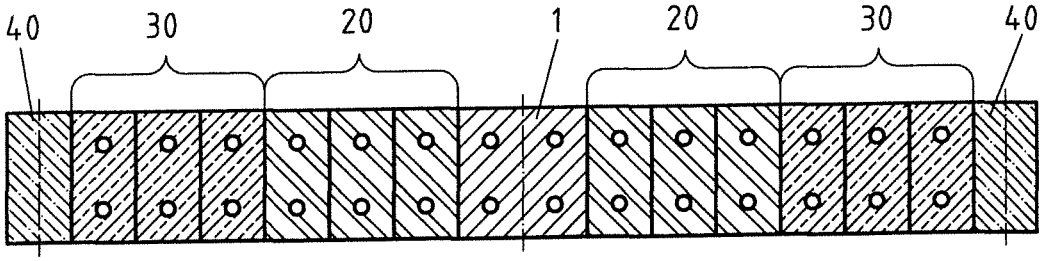
FIG. 5 shows an embodiment of a spray bar assembled from the blocks.

FIG. 5 shows an embodiment of a spray bar 47 composed of blocks 1, 20, 30, 40, which are braced together in a fluid-tight manner by one or more bracing element(s) (not shown). The number of central and outer extension blocks 20, 30 shown here refers to the embodiment shown in FIG. 5 and may vary depending on the desired width of the rolled material. As can be seen from the illustration, the spray bar 47 comprises a central connection block 1, three central extension blocks 20 arranged on each side of the connection block 1, followed by three outer extension blocks 30 arranged on each side of the central extension blocks 20, along with an outer connection block 40 arranged at each of the two distal ends of the spray bar 47.

The main advantage of the modular spray bar system 2 is that it provides a solution tailored to the respective requirements of the rolling mill stand and/or the changing rolling task. As shown in FIG. 5, the respective blocks 1, 20, 30, 40 may be individually assembled to form the spray bar 47. Due to the fact that there are only four different types of blocks 1, 20, 30, 40, the system 2 can also be produced particularly cost-effectively and does not require the respective customer to keep any spare parts, such that additional storage costs can be avoided. Furthermore, in the event of wear, the system 2 allows rapid maintenance in that the respective blocks 1, 20, 30, 40 can be replaced without the entire spray bar 47 having to be removed at great expense. The main advantage of the structure described here is that, in the event of wear, it is not necessary to refabricate the entire spray bar, but only the affected components. In addition, the advantage is that, depending on the rolling task, a spray bar can be assembled from prefabricated modules.

LIST OF REFERENCE SIGNS

1 Central connection block
2 Spray bar system
3 First fluid connection
4 First main bore
5 Main bore
6 First transverse bore
7 First transverse bore
8 Second transverse bore
9 Second transverse bore
10 First fluid outlet opening
11 First fluid outlet opening
12 Second fluid outlet opening
13 Second fluid outlet opening
14 Nozzle plate
15 Nozzle plate
16 Opening
17 Opening
18 Opening
19 Opening
20 Central extension block
21 First main bore
22 Second main bore
23 First transverse bore
24 Second transverse bore
25 First fluid outlet opening
26 Second fluid outlet opening
27 Nozzle plate
28 Opening
29 Opening
30 Outer extension block
31 First main bore
32 Second main bore
33 First transverse bore
34 Second transverse bore
35 First fluid outlet opening
36 Second fluid outlet opening
37 Nozzle plate
38 Opening
39 Opening
40 Outer connection block
41 Second fluid connection
42 Third fluid connection
43 First main bore
44 Second main bore
45 First main fluid channel
46 Second main fluid channel
47 Spray bar

The invention claimed is:

1. A modular spray bar system (1) for selectively cooling and/or lubricating rolls and/or rolled material in a rolling mill, comprising different blocks, including at least one central connection block (1) having at least one first fluid connection (3), wherein the at least one first fluid connection (3) opens into a first through bore (4) extending in the direction of a spray bar axis, wherein the first through bore (4) forms a part of a first fluid channel (45) of a spray bar (47), and wherein at least one first transverse bore (6) extends transversely from the first through bore (4) and opens into a first fluid outlet opening (10, 11);

at least two central extension blocks (20) connectable to the central connection block (1), wherein each of the central extension blocks (20) has a first through bore (21) extending in the direction of the spray bar axis, the first through bore (21) forming a part of the first fluid channel (45) of the spray bar (47), and wherein at least one first transverse bore (23) extends transversely from the first through bore (21) and opens into a first fluid outlet opening (25);

at least two outer extension blocks (30) connectable to the central extension blocks (20), wherein each of the outer extension blocks (30) has a first through bore (31) extending in the direction of the spray bar axis, the first through bore (31) forming a part of the first fluid channel (45) of the spray bar (47), and wherein at least one first transverse bore (33) extends transversely from the first through bore (31) and opens into a first fluid outlet opening (35);

at least two outer connection blocks (40) connectable to the outer extension blocks (30), each having at least one second fluid connection (41), wherein the at least one second fluid connection (41) opens into a first blind bore (43) that is closed on one side and extends in the direction of the spray bar axis, the first blind bore (43) forming an end part of the first fluid channel (45) of the spray bar (47), and at least one brace by which the spray bar (47) formed from the blocks can be braced.

2. The modular spray bar system (1) according to claim 1, wherein the at least one central connection block (1), the at least two central extension blocks (20), and the at least two outer extension blocks (30) each have a second through bore (5, 22, 32, 44) running parallel to the first through bore (4, 21, 31, 43), and wherein each second through bore (5, 22, 32, 44) forms a part of a second fluid channel (46) of the spray bar (47).

3. The modular spray bar system (1) according to claim 2, wherein the at least one central connection block (1), the at least two central extension blocks (20), and the at least two outer extension blocks (30) each comprise at least one second transverse bore (8, 9, 24, 34), which extends transversely from the respective second through bore (5, 22, 32) and opens into a second fluid outlet opening (12, 13, 26, 36).

4. The modular spray bar system (1) according to claim 2, wherein each of the at least two outer connection blocks (40) comprises at least one respective third fluid connection (42), which opens into a second blind bore (44).

5. The modular spray bar system (1) according to claim 4, wherein the second through bore (44) of each of the at least two outer connection blocks (40) is closed on one side.

6. The modular spray bar system (1) according to claim 2, wherein the second fluid channel (46) has a larger cross-section than the first fluid channel (45).

7. The modular spray bar system (1) according to claim 1, wherein the at least one central connection block (1), the at least two central extension blocks (20), and the at least two outer extension blocks (30) each comprises at least one nozzle plate (15, 27, 37) for receiving spray nozzles.

8. The modular spray bar system (1) according to claim 1, wherein the at least one central connection block (1), the at least two central extension blocks (20), and the at least two outer extension blocks (30) each comprises at least one integrated control valve via which individual and/or groups of spray nozzles can be controlled.

9. The modular spray bar system (1) according to claim 1, wherein each of the blocks (1, 20, 30, 40) has at least one connection bore for receiving a fastener on its contact surfaces directed towards a neighboring one of the blocks.

10. The modular spray bar system (1) according to claim 1, wherein the at least two outer connection blocks (40) each have at least one connector for connecting the spray bar (47) in a rolling mill stand.

11. The modular spray bar system (1) according to claim 1, wherein the first through bores (4, 21, 31) of the at least one central connection block (1), the at least two central extension blocks (20), and the at least two outer extension blocks (30) are coaxially aligned, and wherein the first fluid channel (45) is a cylindrical channel that extends through the at least one central connection block (1), the at least two central extension blocks (20), the at least two outer extension blocks (30), and into the at least two outer connection blocks (40).

12. The modular spray bar system (1) according to claim 1, wherein the first fluid connection (3) is arranged on a rear of the at least one central connection block (1) opposite the first fluid outlet opening (10, 11), and wherein the at least one second fluid connection (41) is arranged on a rear of each respective outer connection block (40).

* * * * *